US010464114B2

(12) United States Patent
Angerer et al.

(10) Patent No.: US 10,464,114 B2
(45) Date of Patent: Nov. 5, 2019

(54) BENDING TOOL HAVING A LONGITUDINAL-OFFSET MEASURING DEVICE

(71) Applicant: TRUMPF Maschinen Austria GmbH & Co. KG., Pasching (AT)

(72) Inventors: Gerhard Angerer, Altenberg (AT); Klemens Freudenthaler, Linz (AT); Josef Gaggl, Steyr (AT); Florian Hausmann, Traun (AT); Matthias Hoerl, Oberndorf/Tirol (AT); Nenad Kovjenic, Linz (AT); Helmut Theis, Pfarrkirchen (AT); Manfred Waldherr, Linz (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 346 days.

(21) Appl. No.: 15/535,814

(22) PCT Filed: Dec. 14, 2015

(86) PCT No.: PCT/AT2015/050316

§ 371 (c)(1),
(2) Date: Jun. 14, 2017

(87) PCT Pub. No.: WO2016/094918

PCT Pub. Date: Jun. 23, 2016

(65) Prior Publication Data

US 2017/0333967 A1 Nov. 23, 2017

(30) Foreign Application Priority Data

Dec. 17, 2014 (AT) ..... A 50918/2014

(51) Int. Cl.
*B21D 5/02* (2006.01)
*B21D 5/00* (2006.01)
(Continued)

(52) U.S. Cl.
CPC ..... *B21D 5/006* (2013.01); *B21C 51/00* (2013.01); *B21D 5/002* (2013.01); *B21D 5/004* (2013.01);
(Continued)

(58) Field of Classification Search
CPC ..... B21D 5/006; B21D 5/004; B21D 5/0209; B21D 5/0263; B21D 5/04; B21D 5/002; B21D 55/00; B21D 5/0272; B21C 51/00
(Continued)

(56) References Cited

U.S. PATENT DOCUMENTS 8,584,496 B2 * 11/2013 Kuwayama ..... B21D 22/02 72/21.1
9,778,013 B2 * 10/2017 Gesuita ..... G01B 5/24
(Continued)

FOREIGN PATENT DOCUMENTS

DE 40 42 732 B4 9/2004
DE 10 2009 019 528 A1 12/2009
(Continued)

OTHER PUBLICATIONS

International Search Report of PCT/AT2015/050316, dated Mar. 23, 2016.

*Primary Examiner* — David B Jones
(74) *Attorney, Agent, or Firm* — Collard & Roe, P.C.

(57) ABSTRACT

The invention relates to a lower tool (1) having a longitudinal-offset measuring device (2), which lower tool (1) is part of a bending tool arrangement for use in a bending press. The lower tool (1) has a tool body (3) having a longitudinal extension (4), in which longitudinal extension (4) a bending recess (5) is provided. The bending recess (5) extends from an upper flat side (6) of the tool body (3) into the latter and is formed at least by two contact surfaces (7). The transition from the upper flat side (6) into the bending
(Continued)

Figure 1:
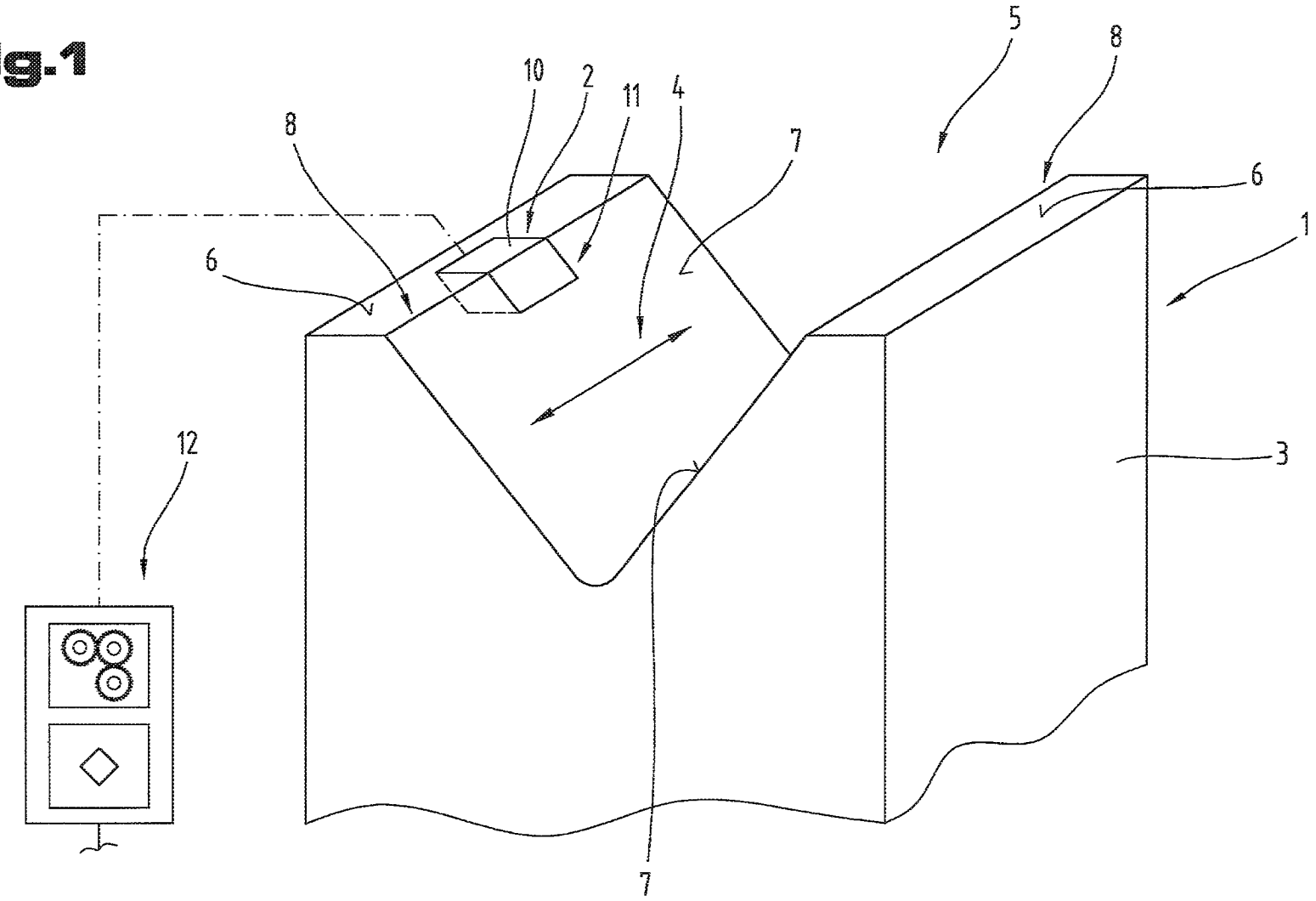

recess (5) forms a contact edge (8), which contact edge (8) forms a contact line (9) in the longitudinal extension (4). A sensor (10) for determining a longitudinal offset (18) is arranged in the region of the contact line (9), wherein a sensing portion (11) of the sensor (10) is oriented in the direction of a metal sheet (16) to be bent.

24 Claims, 5 Drawing Sheets

(51) Int. Cl.
*B21D 55/00* (2006.01)
*B21D 5/04* (2006.01)
*B21C 51/00* (2006.01)

(52) U.S. Cl.
CPC ..... *B21D 5/0209* (2013.01); *B21D 5/0263* (2013.01); *B21D 5/0272* (2013.01); *B21D 5/04* (2013.01); *B21D 55/00* (2013.01)

(58) Field of Classification Search
USPC ..... 72/17.3, 21.4
See application file for complete search history.

(56) References Cited

U.S. PATENT DOCUMENTS

| | | | | |
|---|---|---|---|---|
| 2004/0128846 | A1* | 7/2004 | Horn | B21D 5/002 33/549 |
| 2015/0153148 | A1* | 6/2015 | Angerer | B21D 5/0209 72/379.2 |
| 2016/0151820 | A1* | 6/2016 | Woidasky | B21D 5/0272 72/20.2 |
| 2017/0333967 | A1* | 11/2017 | Angerer | B21D 5/004 |
| 2019/0210083 | A1* | 7/2019 | Angerer | B21D 5/002 |

FOREIGN PATENT DOCUMENTS

| | | | |
|---|---|---|---|
| DE | 10 2008 038 932 | A1 | 2/2010 |
| EP | 0 166 351 | A2 | 1/1986 |
| EP | 2 529 850 | A1 | 12/2012 |
| WO | 2011/038716 | A1 | 4/2011 |
| WO | 2012/155168 | A1 | 11/2012 |

* cited by examiner

BENDING TOOL HAVING A LONGITUDINAL-OFFSET MEASURING DEVICE

CROSS REFERENCE TO RELATED APPLICATIONS

This application is the National Stage of PCT/AT2015/050316 filed on Dec. 14, 2015, which claims priority under 35 U.S.C. § 119 of Austrian Application No. A 50918/2014 filed on Dec. 17, 2014, the disclosure of which is incorporated by reference. The international application under PCT article 21(2) was not published in English.

The invention relates to a bending tool having a longitudinal-offset measuring device for use in a bending machine, in particular a press brake or panel bender.

A major requirement when bending sheet metal parts is to keep to the required bending geometry because by contrast with bottom bending, the sheet metal part to be bent is not pressed against a contact surface of the tool. The bending geometry obtained in this instance depends on the force and/or pressing depth with which the sheet metal part is pressed into the lower tool of the bending tool arrangement, determined on the basis of a computed model, and in the case of panel bending on the degree to which the bending beam is moved during the bending operation. The bending pressure with which the bending press presses the upper tool against the sheet metal part being bent and hence into the lower tool essentially depends on the material properties of the sheet metal part being formed. Due to fluctuations in the material parameters of the sheet metal part being formed, in particular the sheet thickness and/or material strength, the pressing pressure or pressing depth determined on the basis of the model or the calculated trajectory of the bending beam may not be correct for the bending operation currently being performed and may therefore result in a different bending geometry, in particular a different bending angle and/or an incorrect side length. In panel bending, a deviation from the desired bending angle occurs primarily due to the spring-back effect after the bending operation. Specifically in the case of high-precision sheet metal parts involving a plurality of individual bending operations, errors in the bending geometry can rapidly accumulate to the degree that the sheet metal part is rendered unusable.

It is therefore of advantage if the bending geometry obtained at any one time can be determined whilst the bending process is still being carried out and thus applied directly as a means of controlling and influencing the bending operation.

In the context of panel bending, the terms pivot and move are understood as meaning that, as viewed in the direction of the bending line, the trajectory of the bending beam may have a general contour. In one special situation, this may be a circular path with the point at which the sheet is clamped by the clamping tools as the center point. In particular, the trajectory may also have a complex contour. It is then important that there is as little sliding movement of the sheet relative to the bending beam as possible to enable a high surface quality to be obtained.

When air bending sheet metal parts, the sheet to be bent is placed in a bending tool arrangement, which bending tool arrangement is made up of at least one lower tool and an upper tool. The bending tool arrangement is inserted in a bending machine and drive means are activated by a machine controller in such a way that the bend is formed. The upper tool, also referred to as a bending punch, is preferably moved by drive means of the bending machine in the direction of the lower tool, also known as a bending die, as a result of which the sheet to be formed is pressed into the bending recess.

In the case of panel bending, the sheet is clamped between the upper and lower clamping tool, the upper or lower bending beam is positioned in front of the sheet and the bend is formed by pivoting the bending beam. In this connection, the required bending angle can be predefined by the pivot angle but due to the trajectory of the motion, a bending radius occurs that is not exactly known, which means that the angle can also not be exactly predefined. Furthermore, a rebound also occurs in this instance, which is essentially influenced by the variation of the material properties.

Due to material tolerances of the sheet being bent; it may be that the required bending geometry based on the determined bending parameters, in particular the determined pressing force and/or pressing depth or pivot angle, is not achieved. For example, an incorrect bending angle may occur and/or, due to a deviation from the anticipated or calculated bend allowance, an undesired side length may occur. To avoid having to take complex and time-consuming measurements of the bending geometry currently obtained, devices are known from the prior art by means of which the bending angle can be determined at any stage during the bending operation. In addition to measuring devices that involve contact, some systems are known which operate without contact in particular. For example, WO 2012/155168 A1 discloses an optically operated system whereby the bending angle can be measured at any point along the bending line. The disclosed system has a light source which is disposed so that it can be moved along the press beam. In addition, an imaging device is mounted on the end of the bending die. Using a special optical system and an image analysis and evaluation process, the bending angle of the illuminated section of the sheet can be determined from the captured images. However, it is necessary to make modifications to the bending press in order to use the disclosed system and in particular the illuminating equipment and imaging device have to be mounted on the bending press.

The objective of the invention is to improve a bending operation so that the bending geometry can be determined as it occurs whilst the bend is being formed. This should be possible in particular without the need for complex modification work and should be universally applicable for a plurality of bending machines. The design should also be very compact so as to be protected against the stresses which occur during bending operations as far as possible.

The objective of the invention is achieved by means of a bending tool having a longitudinal-offset measuring device, which bending tool is part of a bending tool arrangement for use in a bending machine. A sheet to be bent is placed in the bending tool arrangement and the bending tool also has a tool body having a longitudinal extension, which longitudinal extension is aligned parallel with a bending line. Disposed parallel with this longitudinal extension and oriented in the direction of the sheet to be bent are two contact surfaces or at least one contact edge. A sensor for determining a longitudinal offset is disposed in the region of the contact edge or in a contact surface and a sensing portion of the sensor is oriented in the direction of a sheet to be bent.

The other components of a bending machine needed to produce a bend will not be described in detail. In particular, it will be taken as known that a sheet is formed by a relative movement of the components of the bending tool arrangement, thereby obtaining the desired bending geometry. In this context, one tool component usually remains stationary relative to the bending machine and the other produces the bend due to the force applied by a drive means of the bending machine. However, also included is a design where a number of components of the bending tool arrangement move relative to one another.

By contact edge or contact line is meant that section of the bending tool which is in contact with the sheet during the bending operation and thus enables the major part of the pressing force applied by a drive means of the bending machine to the bending tool to act on the sheet and thus produce the bend. This contact edge or contact line may be a physical edge on the bending tool but it may also be that this edge or line is an imaginary edge or line which corresponds to the contact with the sheet and the physical edge or line whilst the bend is being produced.

Based on another embodiment, the sensor is disposed without an offset in relation to the contact edge or contact line. This means that the position of the sensor in relation to the contact edge or contact line is not changed by the sheet being pressed into the bending recess and/or due to the sheet sliding on the bending tool.

In the case of another embodiment, the sensor is configured so that it can be pivoted about the contact line. This can be achieved if, for example, the main body has a section in which the contact line is interrupted and the sensor is disposed in this section. This ensures that the sensor, in particular the sensing portion of the sensor, can be oriented relative to the sheet throughout the entire bending operation.

In another embodiment, the bending tool is the lower tool of a bending press and the contact surfaces are formed by pivoting jaws, which pivoting jaws are pivotable about a pivot axis parallel with the contact line. Such pivoting jaws are used when bending sensitive sheet surfaces, in particular to prevent surface quality from being impaired by the bending operation. The latter lie on the sheet during the bending operation so that the pressing force is distributed across a larger surface. The contact edge or contact line in this embodiment should be understood as being the imaginary edge or line at which the force vector of the pressing force is directed from the sheet into the tool body of the lower tool.

Based on another embodiment where the bending tool is the lower tool of a bending press, the contact surfaces form a bending recess of a V-shaped bending die, which bending recess extends from an upper flat side of the tool body and in the direction away from the sheet to be formed into the tool body. When performing an air bending operation, the accuracy of the bending geometry that can be achieved will very much depend on the degree to which the sheet is pulled into the lower tool. If this is determined whilst the bend is being produced, direct corrective action will be possible because the pressing depth of the bending punch into the bending die can be adjusted, for example.

Based on another embodiment, the sensor is provided in the form of an illuminating device and an image capturing device. The illuminating device is preferably provided in the form of an LED or laser and the image capturing device is a 2D image sensor. Such systems are known from computer technology, for example, where they are used in optical mice. Their particular advantage is that because of their widespread use, they are available as very compact and inexpensive sensor modules. These modules illuminate a section of a surface and detect images of the illuminated section in rapid succession, which images are forwarded for further processing.

In the case of another embodiment, the sensor is provided in the form of a transmitter and receiver for electromagnetic radiation. Since the sheet to be bent is usually made from metal, another option is to detect a longitudinal offset on the basis of an eddy current measurement. This being the case, a magnetic rotational field is generated in the sheet by the transmitter, which induces a voltage in a receiver in the event of a movement of the sheet due to bending. Based on the choice of excitation frequency and the physical design or spacing of transmitter and receiver coils, the induced voltage can be used to determine the longitudinal offset causing this voltage.

In the case of another embodiment, the sensor is disposed in a recess of at least one of the contact surfaces. When detecting the longitudinal offset, it is important that the sensor is as close as possible to the sheet surface. Based on another embodiment, the sensing flat face of the sensor is disposed in the tool body spaced apart from the contact surface by an offset. This ensures that the sensor is not damaged by the sheet sliding along the sensor. Due to the force generated by the upper tool during the bending operation, the sheet is pushed against the contact edge or contact surfaces and moves into the bending recess as the bending operation progresses. The sensing surface of the sensor is preferably disposed in the sensing flat face. The claimed offset guarantees that as it moves longitudinally relative to the sensor, the sheet does not lie on the latter which could otherwise damage the sensing surface. This embodiment is of particular advantage if using sensors which operate without contact.

Apart from using the proposed bending tool in a bending press for air bending or bottom bending, the bending tool can also be used in a panel bender. Based on another embodiment, therefore, the bending tool is a bending beam of a panel bender. During the bending operation, the sheet metal part to be formed is not pressed into a lower tool by an upper tool and instead, the sheet clamped by the clamping tool is bent about the desired angle by the bending beam. Since the basic features involved in air bending and bottom bending are similar, the aforementioned embodiments may also be used on a panel bender.

Based on another embodiment, the sensor is disposed in a section of a front end of the bending beam, which front end is in contact with the sheet whilst the bend is being produced. This embodiment ensures that the sensor always remains in contact with the sheet whilst the bend is being produced, thereby enabling the relative movement to be continuously detected.

Based on yet another embodiment, a contact element is disposed in the region of the front end, which contact element is mounted so as to be pivotable relative to the bending beam about the contact edge or rotatable about an axis parallel with the contact edge, and this contact element does not transmit any pressing force to the sheet. Due to the specific movement of the bending beam in panel bending operations, the contact line at which the bending beam makes contact with the sheet may undergo a slight change in terms of its position in relation to the front end of the bending beam. The orientation of the sensor relative to the sheet may therefore change, which could potentially lead to a detection error. This embodiment ensures that the sensor always remains correctly oriented relative to the sheet.

To this end, based on another embodiment, the contact element has a flat side in which the sensor is disposed and this flat side lies on the sheet during the bending operation.

In the case of another embodiment, the contact element is provided in the form of a sensor disk, which sensor disk rolls on the sheet as the bend is being formed. This being the case, a relative movement between the sensor disk and the front end of the bending beam is detected by the sensor.

Based on another embodiment, the sensor is provided in the form of an insert. This means that a lower tool can be provided, which can be equipped with a sensor as and when needed, for example. Alternatively, sensors of different designs can be used with a lower tool or one sensor can be used in different lower tools. Similarly, another option would be to equip a bending beam with this type of sensor.

Based on another embodiment, the sensor is also connected to an evaluation circuit which is in turn connected to a machine controller or is integrated therein. With this embodiment, the longitudinal offset detected by the sensor during the bending operation is incorporated in the bending process, in particular such that the machine controller halts the bending operation once the desired bending geometry is obtained.

Furthermore, the evaluation circuit has an image analysis and comparison module. An image of the illuminated portion of the sheet surface is periodically captured by the sensor, in particular in rapid succession. Every sheet surface has characteristic features induced by the production process. Due to the longitudinal offset to be detected, the position of these features will vary between the individual detected images. The desired longitudinal offset can be determined from the cumulation of individual offset values taking account of the image capturing frequency.

In the case of another embodiment, the image analysis and comparison module is configured to determine a one-dimensional or two-dimensional motion vector for the longitudinal offset. In the ideal situation, only a one-dimensional longitudinal offset occurs during the bending operation. As it moves down, the upper tool will press the sheet into the bending recess, thereby inducing a longitudinal movement oriented at a right angle to the contact line. If the material parameters of the sheet to be bent are non-uniform or if the downward movement of the upper tool is uneven, the upper tool may transmit a force component to the sheet in the direction parallel with the contact edge. However, this will lead to an undesired bending result. It is therefore of advantage if a two-dimensional motion vector is determined for the longitudinal offset because this will enable warpage and hence stresses in the sheet to be detected.

Similarly, due to such fluctuating material parameters, the bend radius along the bending line may not be uniform in the case of panel bending and there will therefore likewise be a deviation in the bending geometry.

In addition to contactless measuring methods, however, it is also possible for the sensor to be provided in the form of a rolling device in the case of another embodiment. The rolling device, for example a wheel having a surface structure, lies on the sheet surface and determines the longitudinal offset directly, for example be means of a rotary encoder.

The objective of the invention is also achieved by means of a method for determining bending geometry during air bending. This method is implemented on a bending press having a bending tool arrangement, which bending tool arrangement comprises a lower and an upper tool, the lower tool being of the type proposed by the invention. A sheet metal part to be bent is placed in the bending tool arrangement and the air bending operation is implemented such that the upper tool is moved down and the sheet metal part is pressed into a bending recess of the lower tool by the upper tool. Prior to the start of the bending operation, a surface of the sheet metal part to be bent is placed in contact with a sensor for determining a longitudinal offset and reference co-ordinates of the sheet surface for this contact point are determined by reference to the bending machine or tool arrangement. As the bend is being formed, a longitudinal offset of the sheet surface relative to the sensor is determined and the current bending geometry is also determined by an evaluation circuit on the basis of the determined longitudinal offset using a mathematical model of the bending operation.

The position of the sensor or the contact point of the sensor with the sheet surface having been determined relative to the bending machine or bending tool arrangement prior to the start of the bending operation, every relative movement of the sheet by reference to the sensor can be determined whilst the bend is being produced and transformed into a relationship with respect to the bending machine or bending tool arrangement.

Using the reference co-ordinates, the position of a point of the sheet (the sheet surface) in relation to the bending machine and/or bending tool arrangement is fixed. As the sheet is drawn into the bending recess of the lower tool, the sheet will move relative to this determined reference point by the longitudinal offset to be determined.

The objective of the invention is also achieved by a method for determining the bending geometry during a panel bending operation implemented on a panel bender having a bending tool arrangement. The bending tool arrangement comprises a clamping tool and at least one bending beam, a sheet metal part to be bent being placed in the bending tool arrangement, and the air bending operation is implemented such that the sheet metal part is clamped by the clamping tool and the bending beam is placed on the sheet metal part and moved along or pivoted about a trajectory. The bending beam is of the type proposed by the invention. In particular, prior to the start of the bending operation, a surface of the sheet metal part to be bent is placed in contact with a sensor for determining a longitudinal offset. Reference co-ordinates of the sheet surface for this contact point are determined by reference to the panel bender or bending tool arrangement. As the bend is being formed, a longitudinal offset of the sheet surface relative to the sensor is determined and the current bending geometry is also determined by an evaluation circuit on the basis of the determined longitudinal offset using a mathematical model of the bending operation.

Based on another embodiment, the sensor is held in a stationary arrangement relative to the reference co-ordinates whilst the longitudinal offset is being determined. When the sheet surface is contacted by the sensor, a reference relative to the sheet surface is fixed by means of the reference co-ordinates, on the basis of which or in relation to which the longitudinal offset is determined. This embodiment ensures that, independently of the movement of the sheet metal part whilst the air bending operation is being implemented, the sensor remains stationary relative to this reference. The sensor will follow any upward bending of the sheet or sheet side but its position in relation to the reference will remain unchanged.

Based on another embodiment, the lower tool is of the type proposed by the invention and the longitudinal offset of the sheet relative to the contact edge of the lower tool is determined by the sensor. Since the position of the sensor is fixed by the geometric dimensions of the lower tool in this arrangement, the reference co-ordinates are determined based on a knowledge of the tool geometry.

Based on another embodiment, the sensor is mounted by means of a pivoting device in the region of the upper tool or on a press table of the bending press and whilst the bend is being produced, the pivoting device follows the sheet as it is bent up. There are other possible options for mounting the sensor, thereby offering universal application. In particular, it is also possible to retrofit the sensor and pivoting device on an existing bending press without the need for modifications or conversion work.

To provide a clearer understanding, the invention will be described in more detail below with reference to the appended drawings.

Figure 2:
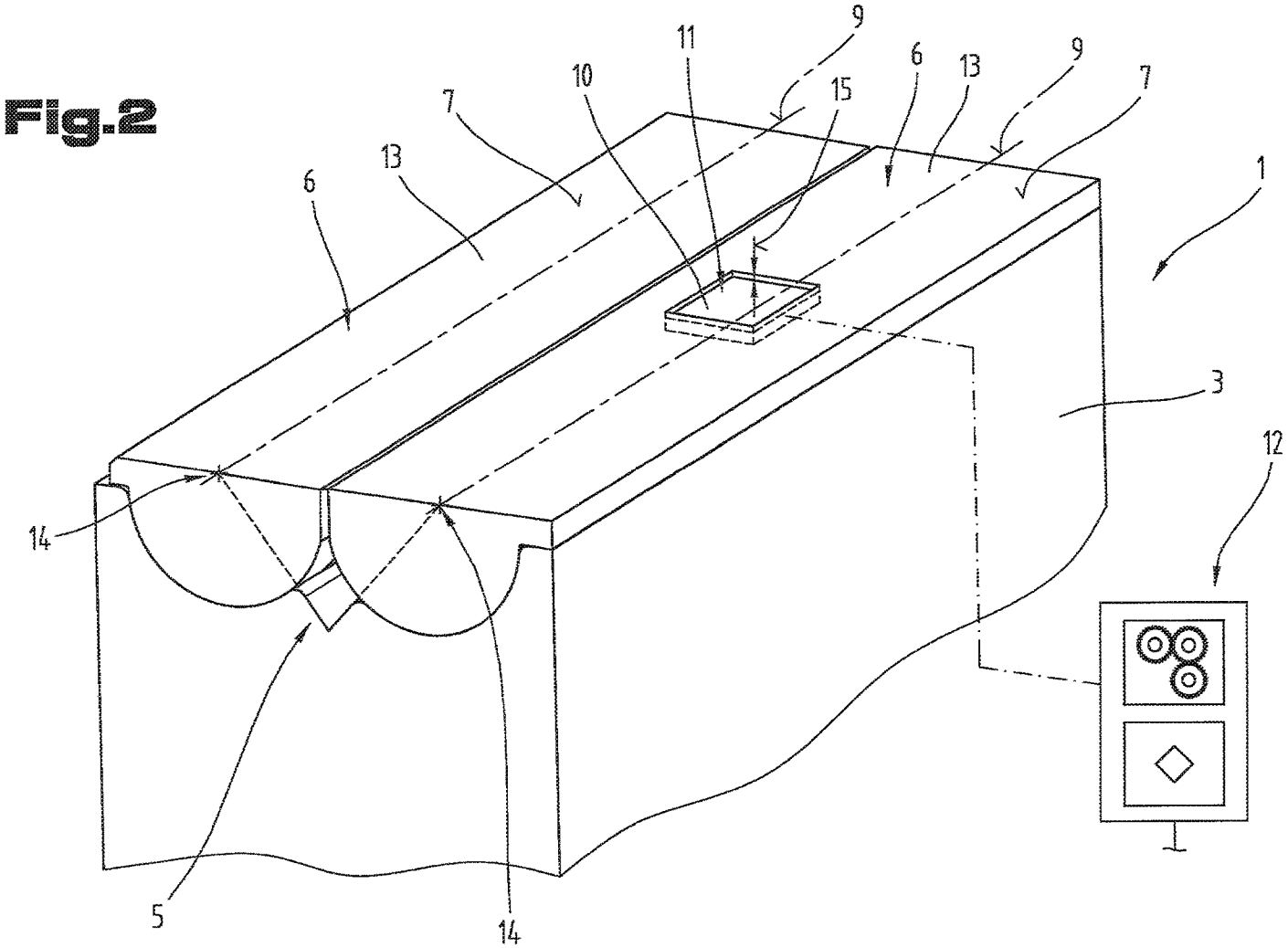
Figure 3A:
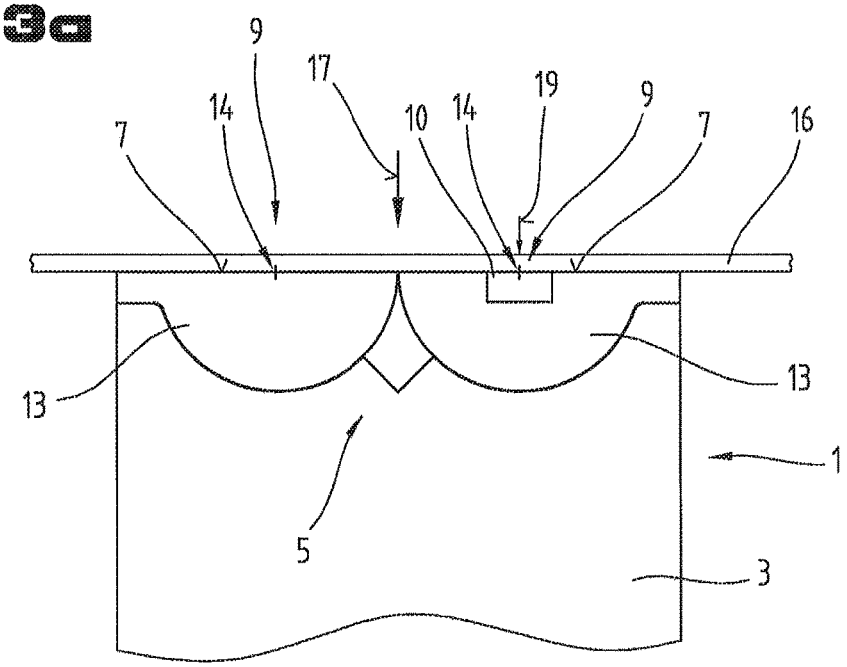
Figure 4:
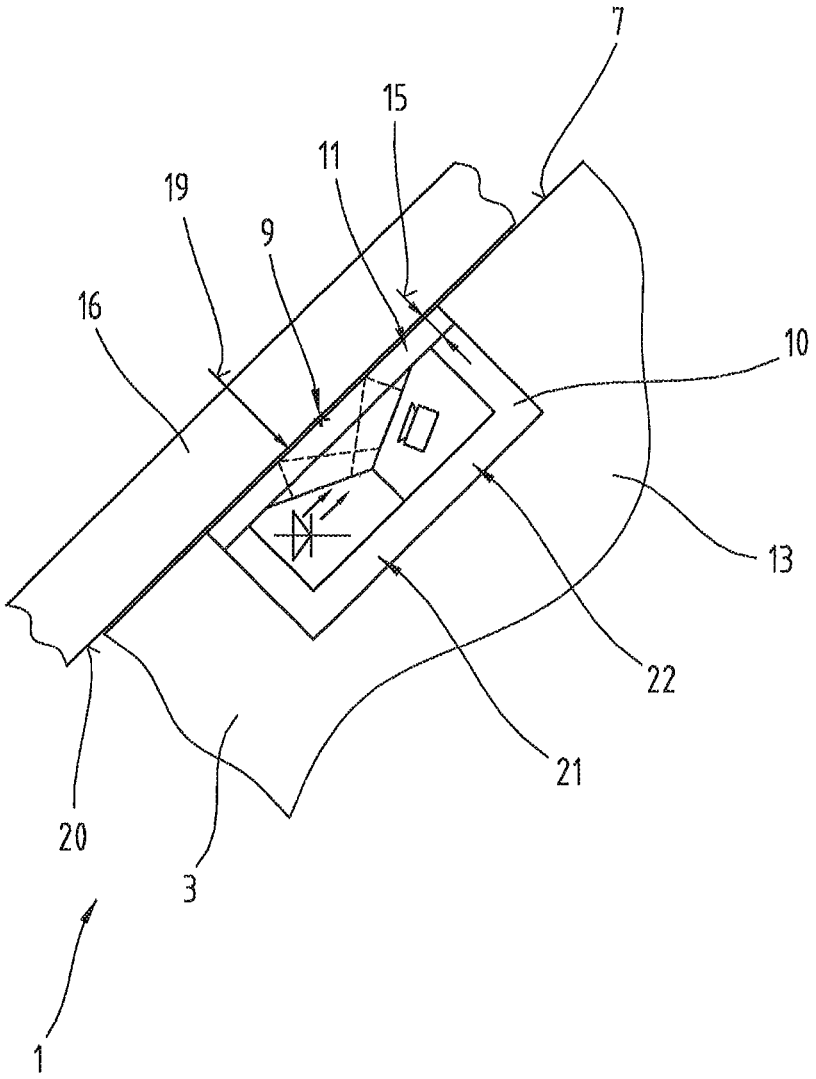

These are highly simplified, schematic diagrams illustrating the following:

FIG. 1 one possible embodiment of the bending tool proposed by the invention;

FIG. 2 another possible embodiment of the bending tool proposed by the invention;

FIGS. 3*a*) and *b*) illustrate the conditions during the bending operation based on one possible embodiment of the bending tool;

FIG. 4 a detail of the sensor;

FIG. 5 an embodiment of the bending tool proposed by the invention for panel bending.

FIG. 1 illustrates one embodiment of a bending tool 1 proposed by the invention having a longitudinal-offset measuring device 2, the bending tool 1 being the lower tool for air bending. The bending tool 1 has a tool body 3 with a longitudinal extension 4, in the direction of which longitudinal extension 4 a bending recess 5 is provided. The bending recess 5 extends from an upper flat side 6 of the tool body 3 into the latter and is formed by two contact surfaces 7. The transition region from the upper flat side 6 to the bending recess 5 forms a contact edge 8. Disposed in the region of the contact edge 8 is a sensor 10, which sensor 10 is configured to determine a longitudinal offset of the sheet to be bent in relation to the sensor. To this end, a sensing portion 11 of the sensor 10 is oriented in the direction of the sheet to be bent.

In FIG. 1, the sensor 10 is disposed solely in the region of a contact edge 8 but it would likewise be possible for a sensor to be provided on the second, oppositely lying contact edge 8 as well.

The sensor 10 is also connected to an evaluation circuit 12, which evaluation circuit 12 is connected to a machine controller, not illustrated, or is integrated in the latter. Furthermore, the evaluation circuit 12 may have an image analysis and comparison module.

In the description of FIG. 1, contact surfaces 7 are mentioned and it should be pointed out that the bending operation is not complete until the sheet is lying on the contact surfaces 7—in which case this would be a bottom bending operation. In the case of air bending, the sheet is pressed into the bending recess 5 but is so only until the desired bending geometry is obtained.

FIG. 2 illustrates another possible embodiment of the bending tool 1 proposed by the invention. In the case of this embodiment, the contact surfaces 7 are provided in the form of pivoting jaws 13, which pivoting jaws 13 can be pivoted about an axis 14 parallel with the contact line 9. In this embodiment, the contact surface 7 simultaneously also constitutes the upper flat side 6 of the tool body 3.

The advantage of a bending tool 1 having pivoting jaws 13 is that the sheet to be bent is placed on the upper flat side 6 or contact surfaces 7 and is supported by the latter across a large surface area. By contrast with the arrangement illustrated in FIG. 1, no linear force is applied along the contact line 9 during the bending operation in this instance. As soon as the sheet being bent is no longer being pressed into the bending recess 5 by the bending punch, the pivoting jaws 13 are pivoted about the pivot axis 14 so that the sheet being bent is always supported by the entire flat side of the contact surface 7 of each pivoting jaw 13. On completion of the bending operation, the pivoting jaws 13 are pivoted completely upwards to form a bending recess 5 with continuous contact surfaces—indicated by broken lines in the drawing.

Disposed in the region of the contact line 9 is a sensor 10 for determining a longitudinal offset and a sensing portion 11 of the sensor is oriented in the direction of the sheet to be bent.

In order to keep the drawings simple, the sheet to be bent is not illustrated in either FIG. 1 or FIG. 2. To the skilled person, however, it will be totally clear that the sheet to be bent is laid on the upper flat side 6 of the tool body 3. When the sheet metal part is being bent by the downwardly moving punch, the sheet is pressed into the bending recess 5, as a result of which the sheet is moved relative to the contact line 9. In particular, it is moved normally with respect to the contact line 9 in the direction of the bottom low point of the bending recess 5 and it is this longitudinal offset that is detected. To ensure that the sensor 10 cannot be damaged due to this longitudinal offset of the sheet as it is pushed against the contact surface 7 by the bending force, the sensor 10 may be mounted so that it is set back from the contact surface 7 by an offset 15.

Again in FIG. 2, only one sensor 10 is illustrated in one contact surface 7 but it would be equally possible to provide one sensor 10 each in both contact surfaces 7.

Figure 3B:
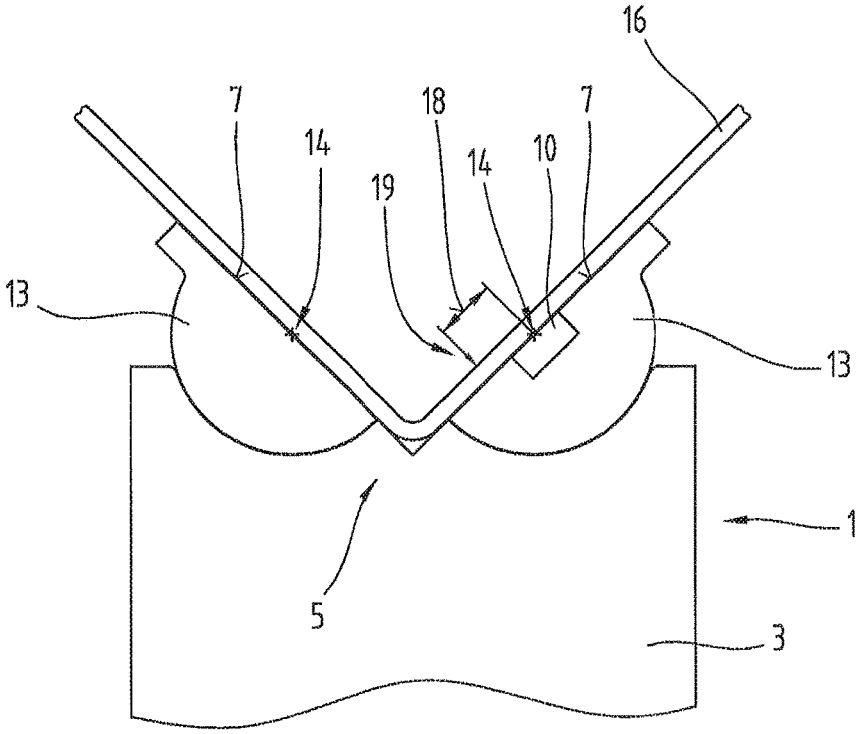

FIGS. 3*a* and 3*b* illustrate how the bending geometry is determined, in particular the side length, by determining the longitudinal offset of the sheet to be bent in the case of an embodiment of the bending tool 1 having pivoting jaws 13.

FIG. 3*a* illustrates the situation in the initial state when a sheet 16 to be bent has been placed on the contact surface 7 of the pivoting jaw 13. The pivoting jaws 13 are pivotable about a pivot axis 14 parallel with the contact line 9. The sensor 10 is mounted in the region of the contact edge or contact line 9 in such a way that when the pivoting jaws 13 are pivoted, no offset of the sensor occurs in relation to the contact line 9 and it is therefore exclusively a relative movement of the sheet 16 sliding relative to the sensor 10 that is detected.

The bending punch, not illustrated, transmits a force 17 onto the sheet 16 during the bending operation so that the latter is pressed into the bending recess 5. To this end, the pivoting jaws 13 are pivoted about the axis 14 so that the contact surfaces 7 of the pivoting jaws 13 always lie on the sheet 16.

Since the sheet 16 is pressed into the bending recess 5 during the bending operation, a relative movement occurs between the sheet 16 and contact surface 7. A surface point 19 will therefore move relative to the sensor 10. This situation is illustrated in FIG. 3*b*.

FIG. 3*b* illustrates the situation in which the desired bend has been obtained, when in particular the two pivoting jaws 13 have been fully pivoted, pressing the sheet 16 into the bending recess 5.

As may also be seen from FIG. 3, the bending operation results in a longitudinal offset 18 of a surface point 19 between the initial position (FIG. 3*a*) and the final position (FIG. 3*b*). In order to highlight the situation, the longitudinal offset has been very much exaggerated in the drawing. This longitudinal offset 18 has a direct influence in particular on the side length of the bent sheet metal part 16 that is obtained. As mentioned above, the pressing force and/or pressing depth for an air bending operation is determined on the basis of a mathematical model of the bending operation. In particular, the set-point sheet thickness and set-point strength of the sheet have a major bearing on the determined parameters. In the event of any deviations from these set-point values, the bending angle obtained will also deviate and/or the side length will deviate so that the bending geometry obtained overall will deviate from what was intended. When it comes to bending complex sheet metal parts, however, the side length to be obtained is of particular importance because deviations in this respect can very rapidly accumulate to a degree beyond predefined tolerances.

By determining the current longitudinal offset 18 and comparing it with a set-point longitudinal offset determined using a bending model enables a conclusion to be drawn directly about the current actual side length.

In addition to the current side length obtained, it is also possible to use the longitudinal offset 18 to gain conclusive information about the bending angle obtained. The pressing depth being known, this value is determined by the machine controller of the bending press and the currently obtained bending angle can be determined from the longitudinal offset 18 via the mathematical model of the bending operation. Based on the set-point values of the bending parameters, a specific path of the material deformation between the contact line 9 or contact edge 8 and the contact point of the bending punch will occur in keeping with the model. This deformation path will also result in a specific longitudinal offset 18. If the material characteristic values are at variance with the set-point values, this will result in particular in a deviation of the determined longitudinal offset from the anticipated longitudinal offset. The currently obtained bending geometry and in particular a variance from the anticipated value can therefore be determined.

FIG. 4 is a diagram illustrating a detail of the sensor 10 for determining a longitudinal offset based on an example of a bending tool having pivoting jaws. The conditions described can also be directly applied to a lower tool for air bending. The sensor 10 is disposed in the tool body 3 of the bending tool 1 in such a way that no offset of the sensor 10 in relation to the contact line 9 or contact edge occurs during the bending operation. The sheet 16 to be bent lies on the contact surface 7 and is therefore pressed by the downwardly moving bending punch about the contact line 9 or contact edge against the contact surfaces 7 and thus bent.

Due to the bending operation, the sheet 16 is pressed in the direction of the bending recess so that a virtual surface point 19 of the sheet surface is moved relative to the sensor 10.

Based on one possible embodiment, the sensor 10 is provided in the form of an illuminating 21 and image capturing device 22. A portion on the sheet surface 20 is illuminated by the illuminating device 21, which illuminated portion is cyclically detected by the image capturing device 22. Due to the constant presence of the surface structure of the sheet surface 20, a constantly changing surface pattern is detected by the image capturing device 22 during the relative movement of the sheet 16 by reference to the sensor 10. The detected images are processed and analyzed by an evaluation circuit, not illustrated, in order to determine a motion vector from the successive images of the illuminated surface portion. Since the image detection frequency and determined motion vector are known, the real longitudinal offset can be determined. On the basis of this longitudinal offset and with a knowledge of the geometry of the bending tool 1, in particular the bending recess, the current bending angle and the currently obtained side length can be determined.

Such a design of sensor 10 having an illuminating 21 and image capturing device 22 is known from the field of optical computer mice, for example. In this instance, from the movement of the sensor in relation to a surface, in particular a desk surface, the movement of the computer mouse is detected and converted into the movement of a cursor on the monitor screen.

To protect the sensor 10 from the sheet 16 as it moves past the contact surface 7 or contact line 9, the sensing portion 11 of the sensor 10 is disposed at a distance from the contact surface 7 by an offset 15. This ensures that the sheet 16 pressed against the contact surface 7 or contact edge at a high pressure does not damage the sensing portion 11 during the relative movement.

The advantage of the lower tool proposed by the invention resides in the fact that essentially every bending machine can be equipped with a function for monitoring bending geometry without the need for physical modifications to the bending machine. An existing set of lower tools can be extended to incorporate a lower tool such as that proposed by the invention, thereby enabling the bending path to be monitored and the desired bending geometry to be adhered to during the course of a bending operation. The function proposed by the invention can also be used in a panel bender, in which case the aspects described in connection with the lower tool may be applied to the bending beam.

FIG. 5 illustrates a bending tool arrangement for use in a panel bending application where the bending tool 1 is a bending beam 23. The bending tool arrangement further comprises another clamping tool 24 and the sheet 16 to be formed is clamped between the upper and lower clamping tool. The sensor 10 is disposed in a front end 25 of the bending beam 23 and the light-emitting direction of the illuminating device 21 and the detecting area of the image capturing device 22 are oriented in the direction of the surface 20 of the sheet 16 to be formed.

Figure 5A:
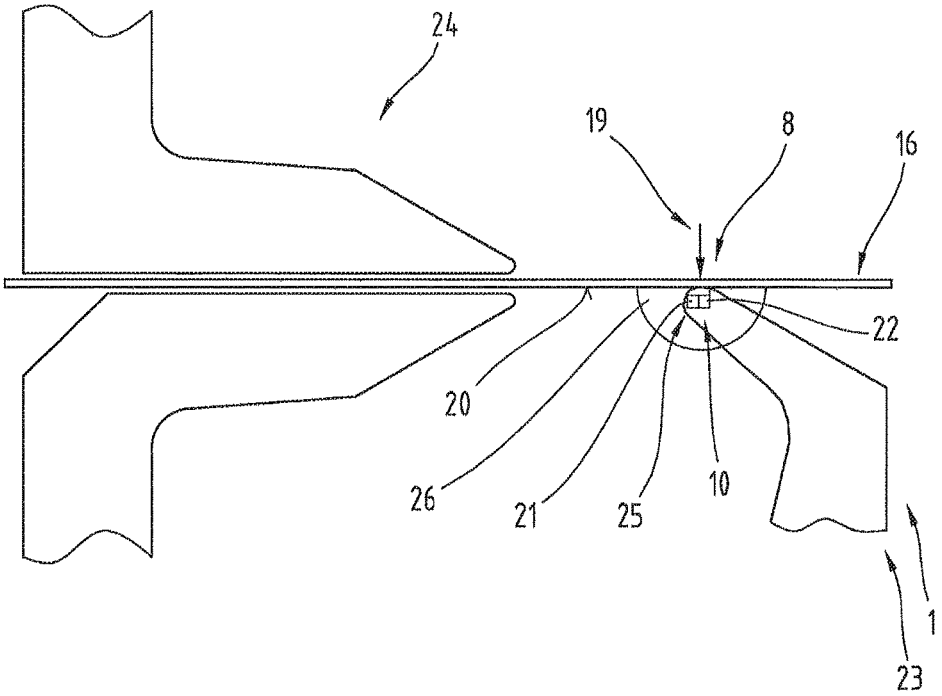

FIG. 5*a* illustrates the situation prior to the start of the bending operation in which the bending beam 23 lies against or along the contact edge 8 on the surface 20 of the sheet 16. For this contact point, the co-ordinates of a surface point 19 are determined by reference to the bending tool arrangement or by reference to the bending machine. The other details as to how the surface point 19 is referenced were explained above.

Figure 5B:
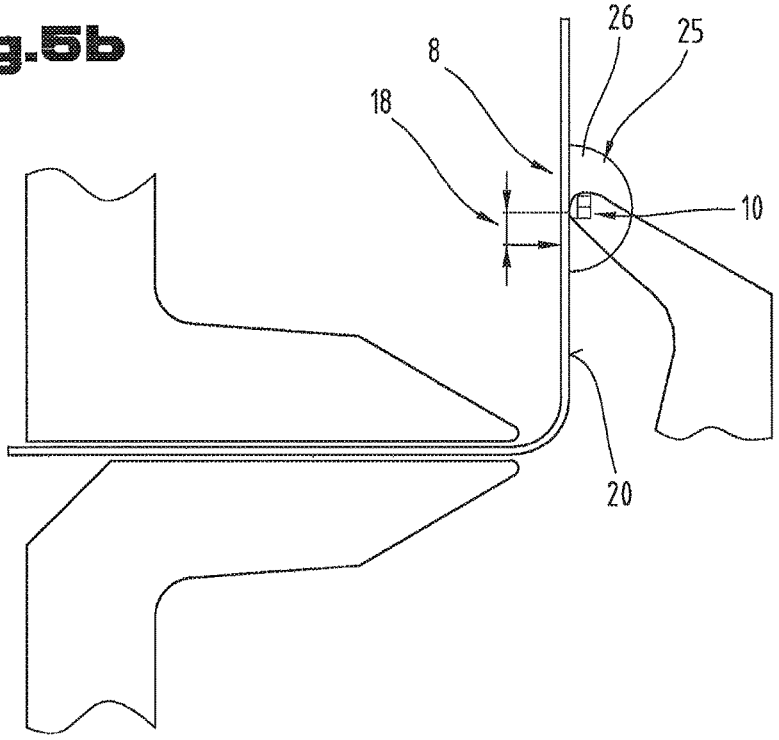

FIG. 5*b* illustrates the situation after the bending operation has been completed, when the bending beam 23 has been moved by a drive means of the bending machine along a path and the bending beam 23 is now in a final position. Due to the pivoting movement of the bending beam 23, the surface point 19 has also shifted by the longitudinal offset 18 relative to the front end 25 of the bending beam 23. From this longitudinal offset 18 and the knowledge of the trajectory of the bending beam 23, information can be gleaned about the path of the bend between the front end 25 of the bending beam and the clamping tool 24 via the mathematical model of the bending operation.

Compared with a bending press, a panel bender offers more options for influencing the trajectory of the bending beam 23. This being the case, corrective action can be taken on detection of a deviation in the path of the longitudinal offset 18 and the trajectory adapted accordingly so that the desired bending geometry can be obtained nevertheless.

FIG. 5 illustrates another possible embodiment in which a contact element 26 is disposed in the region of the front end 25 of the bending beam 23. Due to the very complex path of the trajectory along which the bending beam 23 can be pivoted, it may be that the contact edge 8 does not remain stationary relative to the bending beam 23. This situation may be seen in FIG. 5. Allowance can be made for this offset because the geometry of the bending beam 23 in the region of the contact edge 8 is known and therefore has only a minimal effect when determining the longitudinal offset 18. Under certain circumstances, however, there is a requirement for accuracy of the bending geometry, which makes it necessary to take account of this shifting of the contact edge 8. The advantage of the embodiment having a contact element 26 is that the force introduced by, the drive means of the bending machine into/onto the sheet can be uncoupled from the process of detecting the longitudinal offset 18.

This contact element 26 is provided in the form of a sensor disk and preferably also has a flat side which lies against the sheet 16 and therefore follows the pivoting movement of the sheet 16 relative to the bending beam 23. Since the contact element 26 is not subjected to force and therefore does not have to be involved in any forming work, the pivotable mounting may be based on a design that moves very easily. This makes it possible to adapt particularly effectively to the sheet as it is bent up, thereby ensuring accurate detection of the longitudinal offset 18.

It is also preferable if the sensor 10 follows the pivoting movement of the contact element 26 in terms of its orientation by providing a positive or non-positive connection between the sensor and the contact element. This ensures that the sensor always has the same orientation relative to the sheet and the measurement result for the longitudinal offset cannot be impaired due to a varying orientation between the sensor and sheet.

Finally, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described.

FIGS. 2 and 5 illustrate other and optionally independent embodiments of the bending tool proposed by the invention in their own right, the same reference numbers and component names being used to denote parts that are the same as those described in connection with the other drawings above. To avoid unnecessary repetition, reference may be made to the more detailed description of these drawings given above.

The embodiments illustrated as examples represent possible variants of the bending tool, and it should be pointed out at this stage that the invention is not specifically limited to the variants specifically illustrated, and instead the individual variants may be used in different combinations with one another and these possible variations lie within the reach of the person skilled in this technical field given the disclosed technical teaching.

Furthermore, individual features or combinations of features from the different embodiments illustrated and described may be construed as independent inventive solutions or solutions proposed by the invention in their own right.

The objective underlying the independent inventive solutions may be found in the description.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

Above all, the individual embodiments of the subject matter illustrated in FIGS. 1 to 5 constitute independent solutions proposed by the invention in their own right. The objectives and associated solutions proposed by the invention may be found in the detailed descriptions of these drawings.

For the sake of good order, finally, it should be pointed out that, in order to provide a clearer understanding of the structure of the bending tool, it and its constituent parts are illustrated to a certain extent out of scale and/or on an enlarged scale and/or on a reduced scale.

LIST OF REFERENCE NUMBERS

1 Bending tool
2 Longitudinal offset measuring device
3 Tool body
4 Longitudinal extension
5 Bending recess
6 Flat side
7 Contact surface
8 Contact edge
9 Contact line
10 Sensor
11 Sensing portion
12 Evaluation circuit
13 Pivoting jaw
14 Pivot axis
15 Offset
16 Sheet, sheet metal part
17 Force
18 Longitudinal offset
19 Surface point
20 Sheet surface
21 Illuminating device
22 Image capturing device
23 Bending beam
24 Clamping tool
25 Front end
26 Contact element

The invention claimed is:

1. Bending tool (1) having a longitudinal-offset measuring device (2), which bending tool (1) is part of a bending tool arrangement for use in a bending machine, a sheet (16) to be bent being placed in the bending tool arrangement, and the bending tool (1) has a tool body (3) having a longitudinal extension (4), which longitudinal extension (4) is aligned parallel with a bending line, and two contact surfaces (7) or at least one contact edge (8) are disposed parallel with this longitudinal extension (4) and oriented in the direction of the sheet (16) to be bent, wherein a sensor (10) for determining a longitudinal offset (18) is disposed in the region of the contact edge (8) or in a contact surface (7), and a sensing portion (11) of the sensor (10) is oriented in the direction of a metal sheet (16) to be bent.

2. Bending tool according to claim 1, wherein the sensor (10) is disposed without an offset in relation to the contact edge (8) or contact line (9).

3. Bending tool according to claim 1, wherein the sensor (10) is configured so that it can be pivoted about the contact line (9).

4. Bending tool according to claim 1 where the bending tool is the lower tool of a bending press, wherein the contact surfaces (7) are formed by pivoting jaws (13), which pivoting jaws (13) are pivotable about a pivot axis (14) parallel with the contact line (9).

5. Bending tool according to claim 1 where the bending tool is the lower tool of a bending press, wherein the contact surfaces (7) form a bending recess (5) of a V-shaped bending die, which bending recess extends from an upper flat side (6) of the tool body (3) and in the direction away from the sheet (16) to be formed into the tool body (3).

6. Bending tool according to claim 1, wherein the sensor (10) is provided in the form of an illuminating (21) and image capturing device (22).

7. Bending tool according to claim 1, wherein the sensor (10) is provided in the form of a transmitter and receiver for electromagnetic radiation.

8. Bending tool according to claim 4, wherein the sensor (10) is disposed in a recess of at least one of the contact surfaces (7).

9. Bending tool according to claim 4, wherein a sensing flat face of the sensor (10) is disposed in the tool body (3) spaced apart from the contact surface (7) by an offset (15).

10. Bending tool according to claim 1, wherein the bending tool is a bending beam (23) of a panel bender.

11. Bending tool according to claim 10, wherein the sensor (10) is disposed in a section of a front end (25) of the bending beam (23), which front end (25) is in contact with the sheet (16) whilst the bend is being produced.

12. Bending tool according to claim 11, wherein a contact element (26) is disposed in the region of the front end (25), which contact element (26) is mounted so as to be pivotable relative to the bending beam (23) about the contact edge (8) or rotatable about an axis parallel with the contact edge (8).

13. Bending tool according to claim 12, wherein the contact element (26) has a flat side in which the sensor (10) is disposed and this flat side lies on the sheet (16) during the bending operation.

14. Bending tool according to claim 12, wherein the contact element (26) is provided in the form of a sensor disk, which sensor disk rolls on the sheet (16) as the bend is being formed.

15. Bending tool according to claim 1, wherein the sensor (10) is provided in the form of an insert.

16. Bending tool according to claim 1, wherein the sensor (10) is connected to an evaluation circuit (12) which is in turn connected to a machine controller or is integrated therein.

17. Bending tool according to claim 5, wherein the evaluation circuit (12) has an image analysis and comparison module.

18. Bending tool according to claim 17, wherein the image analysis and comparison module is configured to determine a one-dimensional or two-dimensional motion vector for the longitudinal offset (18).

19. Bending tool according to claim 1, wherein the sensor (10) is provided in the form of a rolling device.

20. Method for determining bending geometry during air bending, implemented on a bending press having a bending tool arrangement, which bending tool arrangement comprises a lower and an upper tool, the lower tool being of the type according to claim 1, and a sheet metal part to be bent is placed in the bending tool arrangement and the air bending operation is implemented such that the upper tool is moved down and the sheet metal part is pressed into a bending recess of the lower tool upper tool, wherein prior to the start of the bending operation, a surface of the sheet metal part to be bent is placed in contact with a sensor for determining a longitudinal offset;

and reference co-ordinates of the sheet surface for this contact point are determined by reference to the bending machine or bending tool arrangement;

and as the bend is being formed, a longitudinal offset of the sheet surface relative to the sensor is determined;

and the current bending geometry is determined by an evaluation circuit on the basis of the determined longitudinal offset using a mathematical model of the bending operation.

21. Method for determining bending geometry during a panel bending operation implemented on a panel bender having a bending tool arrangement, which bending tool arrangement comprises a clamping tool (24) and at least one bending beam, a sheet metal part to be bent being placed in the bending tool arrangement, and the air bending operation is implemented such that the sheet metal part is clamped by the clamping tool (24) and the bending beam (23) is placed on the sheet metal part and moved along or pivoted about a trajectory, and the bending beam (23) is of the type according to claim 1, wherein prior to the start of the bending operation, a surface of the sheet metal part to be bent is placed in contact with a sensor for determining a longitudinal offset;

and reference co-ordinates of the sheet surface for this contact point are determined by reference to the panel bender or bending tool arrangement;

and as the bend is being formed, a longitudinal offset of the sheet surface relative to the sensor is determined;

and the current bending geometry is determined by an evaluation circuit on the basis of the determined longitudinal offset using a mathematical model of the bending operation.

22. Method according to claim 20, wherein the sensor is held in a stationary arrangement relative to the reference co-ordinates whilst the longitudinal offset is being determined.

23. Method according to claim 20, wherein the longitudinal offset of the sheet relative to the contact edge of the lower tool is determined by the sensor.

24. Method according to claim 20, wherein the sensor is mounted by means of a pivoting device in the region of the upper tool or on a press table of the bending press and whilst the bend is being produced, the pivoting device follows the sheet as it is bent up.

* * * * *